US010391659B2

(12) United States Patent
Lee et al.

(10) Patent No.: US 10,391,659 B2
(45) Date of Patent: Aug. 27, 2019

(54) CUTTING MACHINE FOR WINDOW COVERING

(71) Applicant: NIEN MADE ENTERPRISE CO., LTD., Taichung (TW)

(72) Inventors: Wen-Yeu Lee, Tainan (TW); Ching-Fang Yeh, Taichung (TW)

(73) Assignee: NIEN MADE ENTERPRISE CO., LTD., Taichung (TW)

( * ) Notice: Subject to any disclaimer, the term of this patent is extended or adjusted under 35 U.S.C. 154(b) by 500 days.

(21) Appl. No.: 15/012,614

(22) Filed: Feb. 1, 2016

(65) Prior Publication Data

US 2017/0217040 A1 Aug. 3, 2017

(51) Int. Cl.

| | |
|---|---|
| ***B26D 7/01*** | (2006.01) |
| ***B26D 7/28*** | (2006.01) |
| ***B26D 1/08*** | (2006.01) |
| ***E06B 9/36*** | (2006.01) |
| ***E06B 9/266*** | (2006.01) |

(52) U.S. Cl.

CPC ..... *B26D 7/01* (2013.01); *B26D 1/08* (2013.01); *B26D 7/28* (2013.01); *E06B 9/266* (2013.01); *E06B 9/36* (2013.01); *Y10T 83/7487* (2015.04); *Y10T 83/75* (2015.04); *Y10T 83/76* (2015.04); *Y10T 83/858* (2015.04)

(58) Field of Classification Search

CPC .. B26D 7/02; B26D 7/018; B26D 1/08; E06B 9/36; E06B 9/266; Y10T 83/75; Y10T 83/8822; Y10T 83/7507; Y10T 83/858; Y10T 83/7487

USPC ..... 83/614, 196–200, 468, 468.5, 468.6, 83/522.19

See application file for complete search history.

(56) References Cited

U.S. PATENT DOCUMENTS

| | | | | | |
|---|---|---|---|---|---|
| 1,745,815 | A * | 2/1930 | Schoepfle | B65B 61/06 | 269/291 |
| 2,134,332 | A * | 10/1938 | Hubbard | B27G 5/02 | 83/466.1 |
| 3,389,724 | A * | 6/1968 | Paul | B23Q 9/0042 | 269/1 |
| 4,738,177 | A * | 4/1988 | Jones, III | B26D 1/115 | 83/455 |
| 6,003,217 | A * | 12/1999 | Graves | E06B 9/262 | 29/24.5 |
| 6,591,509 | B2 * | 7/2003 | LeBlanc | B23Q 9/0078 | 30/374 |

(Continued)

*Primary Examiner* — Laura M Lee

(74) *Attorney, Agent, or Firm* — Tracy M. Heims; Apex Juris, PLLC.

(57) ABSTRACT

A cutting machine for window coverings is disclosed, which includes a worktable, a first cutting device, and a caliper. An abutting member and at least one series of extending graduation marks are provided on a table surface of the worktable. The caliper includes at least one internal gauge point and at least one external gauge point. By making the internal gauge point or the external gauge point of the caliper point at a scale value of the series of extending graduation marks which matches a height of a window opening, and by cutting the slats, the resultant slats are adapted to be installed to the window opening. In addition, a distance between a surface of the first cutting device which bears the slats and the table surface of the worktable is short, which makes the stacked slats can be cut in a substantially horizontal way.

11 Claims, 10 Drawing Sheets

(56) References Cited

U.S. PATENT DOCUMENTS

| | | | | |
|---|---|---|---|---|
| 6,745,659 | B1 * | 6/2004 | Cunningham | B23D 23/00 269/304 |
| 7,194,811 | B2 * | 3/2007 | Militello | E06B 9/266 33/194 |
| 9,862,111 | B2 * | 1/2018 | Hsu | B26D 5/10 |
| 2011/0041659 | A1 * | 2/2011 | Williams | B26D 1/10 83/13 |
| 2012/0006168 | A1 * | 1/2012 | Swopes | B23D 23/00 83/453 |

* cited by examiner

CUTTING MACHINE FOR WINDOW COVERING

BACKGROUND OF THE INVENTION

1. Technical Field

The present invention relates generally to tools for cutting components of window coverings, and more particularly to a cutting machine, which is convenient and easy to use.

2. Description of Related Art

It is known in the art that a window covering can be installed either inside a window opening (i.e., inside mount) or outside a window opening (i.e., outside mount). For inside mount, in order to ensure the window covering can be smoothly closed or raised after installation, the window covering has to be slightly smaller than the window opening; as for outside mount, the window covering is generally required to be able to cover the whole window opening, so the window covering has to be larger than the window opening.

In spite of there being standard component of window coverings in several sizes available on the market, a standard component typically still needs to be cut to fit a window opening, for there is no consistent size for window openings of different or even the same buildings. The convention way of determining a cut length for a standard component, say slats of a vertical blind, uses a simple ruler with the help of visual estimation; the length of the beam of the window covering and the installation method (i.e., either inside mount or outside mount) should be taken into account as well. However, it seems inevitable to cut too much or too less from time to time, and the resultant slats of a vertical blind may therefore fail to meet the consumer's expectation. If the error is too great, the window covering would be unusable and has to be discarded, which is wasteful. In this sense, the conventional method of cutting window coverings still has room for improvement.

In addition, it's common to stack slats on a worktable of a cutting machine, and if the stacked slats are not appropriately supported or fixed, some of the slats may be biased or shifted, which causes an irregular cut surface. Furthermore, the top surface of the stacked slats is much higher than the surface of the worktable, and therefore the stacked slats have an obvious protrusion at where the slats are supposed to be cut, which may cause slight differences in length among different slats. Though now there are worktables provided with a raised structure, which helps to keep the surface of the staked slats parallel to the worktable to overcome the problem of inconsistent lengths, the complexity of using such a cutting machine is increased as a side effect. On the other hand, the raised structure makes it more difficult to support or fix the slats, and therefore the resultant cut surface of the slats may be still irregular in the end.

BRIEF SUMMARY OF THE INVENTION

In view of the above, the primary objective of the present invention is to provide a cutting machine for cutting components of window coverings, which is able to define a cut size precisely and quickly to meet different requirements, and the resultant length of each slat is consistent.

The present invention provides a cutting machine for cutting components of window coverings, wherein the cutting machine includes a worktable and a cutting device, which is movably provided on the worktable in a slidable way, and is adapted to cut slats of a window covering. The cutting machine is characterized in that, the cutting device comprises a sliding seat, a plurality of rolling members, and a cutter, wherein the sliding seat has a top surface and a bottom surface opposite to the top surface; each of the rolling members is provided in the sliding seat with a part of a surface thereof exposed out of the bottom surface of the sliding seat, so that a distance between the top surface of the sliding seat and a table surface of the worktable is short; the part of each of the rolling members exposed out of the bottom surface of the sliding seat contacts with the table surface of the worktable; the cutter is engaged on the sliding seat, wherein an opening is formed between the cutter and the top surface of the sliding seat; a cutting knife of the cutter is adapted to cut the slats of the window covering which pass through the opening.

The present invention further provides a cutting machine for cutting components of window coverings, which includes a worktable, a cutting device, and a caliper. The worktable has a first abutting member and a series of first extending graduation marks provided on a table surface thereof, wherein the first abutting member projects from the table surface; the series of first extending graduation marks are provided along a long axis of the table surface, and a scale value thereof decreases from an end thereof near the first abutting member to another end away from the first abutting member. The cutting device is movably provided on the worktable, and is slidable along the long axis of the table surface, wherein the cutting device is adapted to cut slats of a window covering. The caliper is adapted to mark a length of the slats for locating the cutting device on the worktable, wherein the caliper comprises a first internal gauge point and a first external gauge point; when the caliper is fixed on a predetermined position on the worktable, the scale value of the series of first extending graduation marks pointed by the internal gauge point is greater than the scale value of the series of first extending graduation marks pointed by the external gauge point.

Whereby, the cut size can be precisely and quickly defined to meet different requirements, and as a result, the resultant component would be good in quality.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
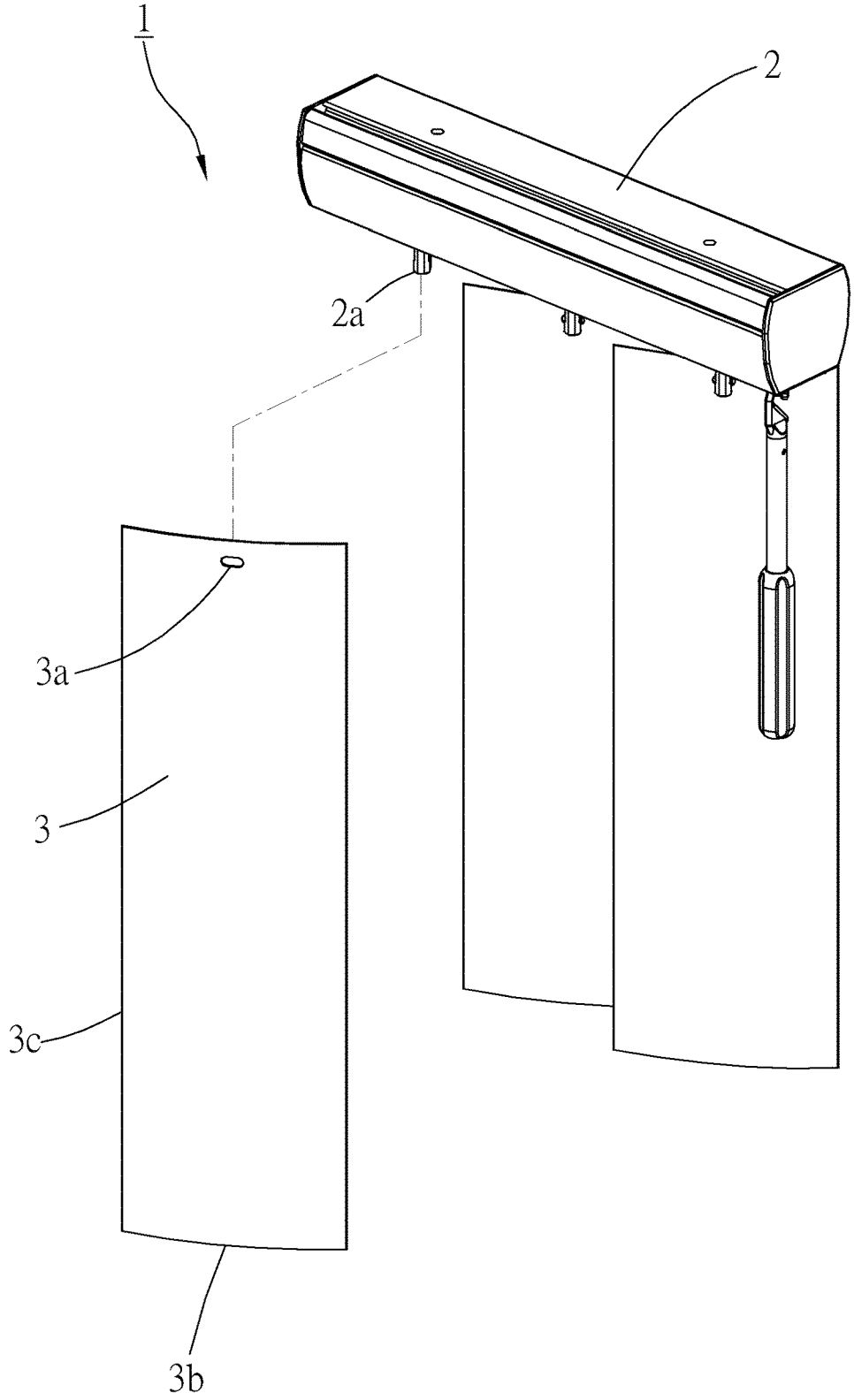
FIG. 1 is a perspective view of a vertical blind.

A cutting machine is provided in the present invention, which is adapted to cut slats of blinds, and a vertical blind is taken as an example in the following description. As shown in FIG. 1, the vertical blind 1 includes a beam 2 and a plurality of slats 3 hung below the beam 2 in a vertical manner, wherein the beam 2 has a plurality of hooks 2*a* provided on a bottom thereof, and each of the slats 3 has a hanging hole 3*a* provided on a top thereof to allow one of the hooks 2*a* to pass therethrough.

Figure 2:
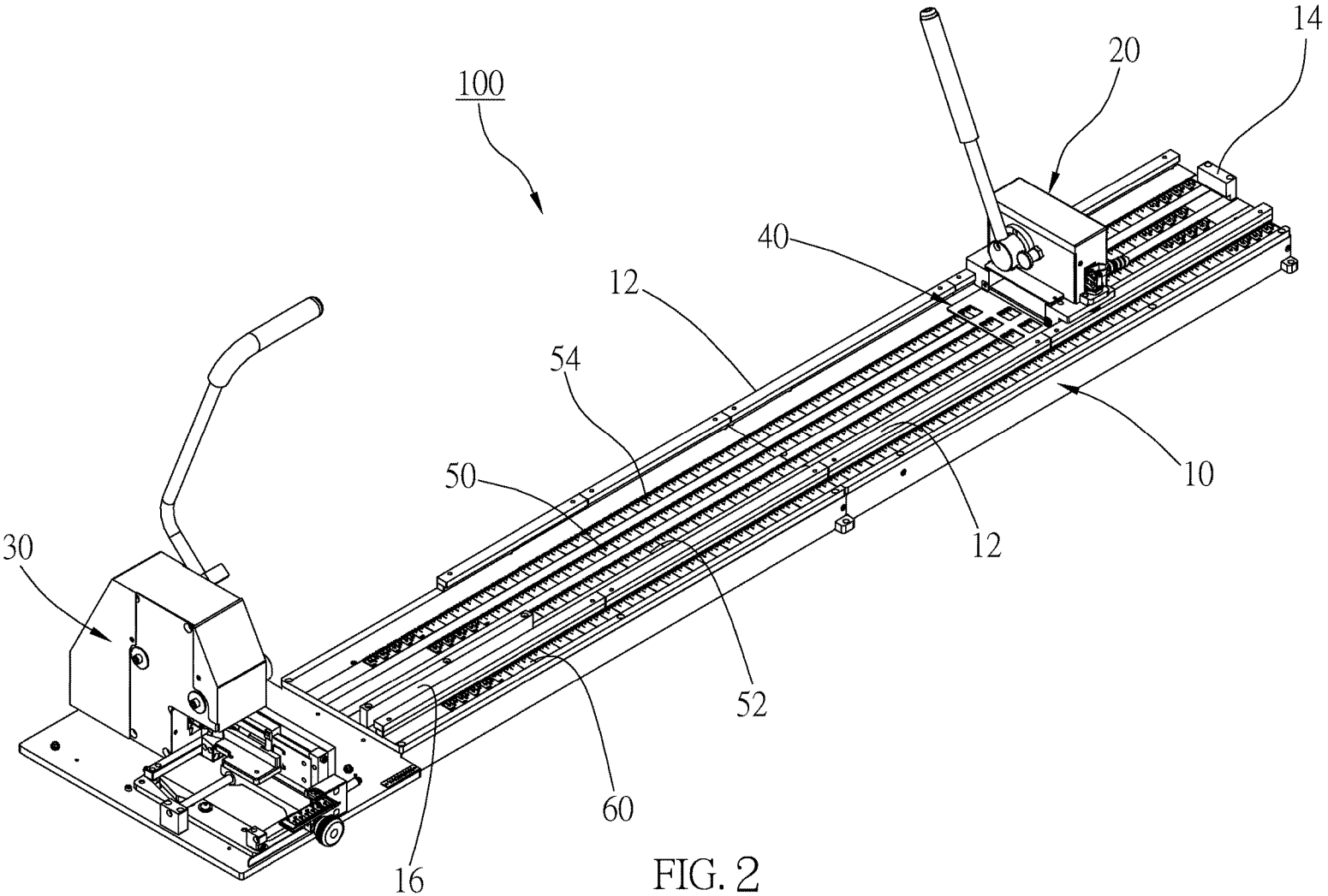
FIG. 2 is a perspective view of a preferred embodiment of the present invention.

As shown in FIG. 2, a cutting machine 100 of a preferred embodiment of the present invention includes a long rectangular shaped worktable 10 and two cutting devices. The cutting devices are respectively provided at two ends of the worktable 10 along a long axis thereof. For easier explanation, the cutting devices are respectively defined as a first cutting device 20 and a second cutting device 30, wherein the first cutting device 20 is adapted to cut the slats 3, and the second cutting device 30 is adapted to cut beams, e.g. the beam 2, of the vertical blind 1.

The worktable 10 has two rails 12 provided on a surface thereof, wherein the rails 12 are in parallel and along the long axis of the worktable 10. In addition, a first abutting member 14 and a second abutting member 16 project on the surface of the worktable 10. The first abutting member 14 is located at an edge of the worktable 10, and is near the first cutting device 20; the first abutting member 14 is adapted to abut against an end edge 3*b* of the slats 3. The second abutting member 16 is away from the first abutting member 14, and is near the second cutting device 30; the second abutting member 16 is adapted to abut against a lateral edge 3*c* of the slats 3.

Figure 3:
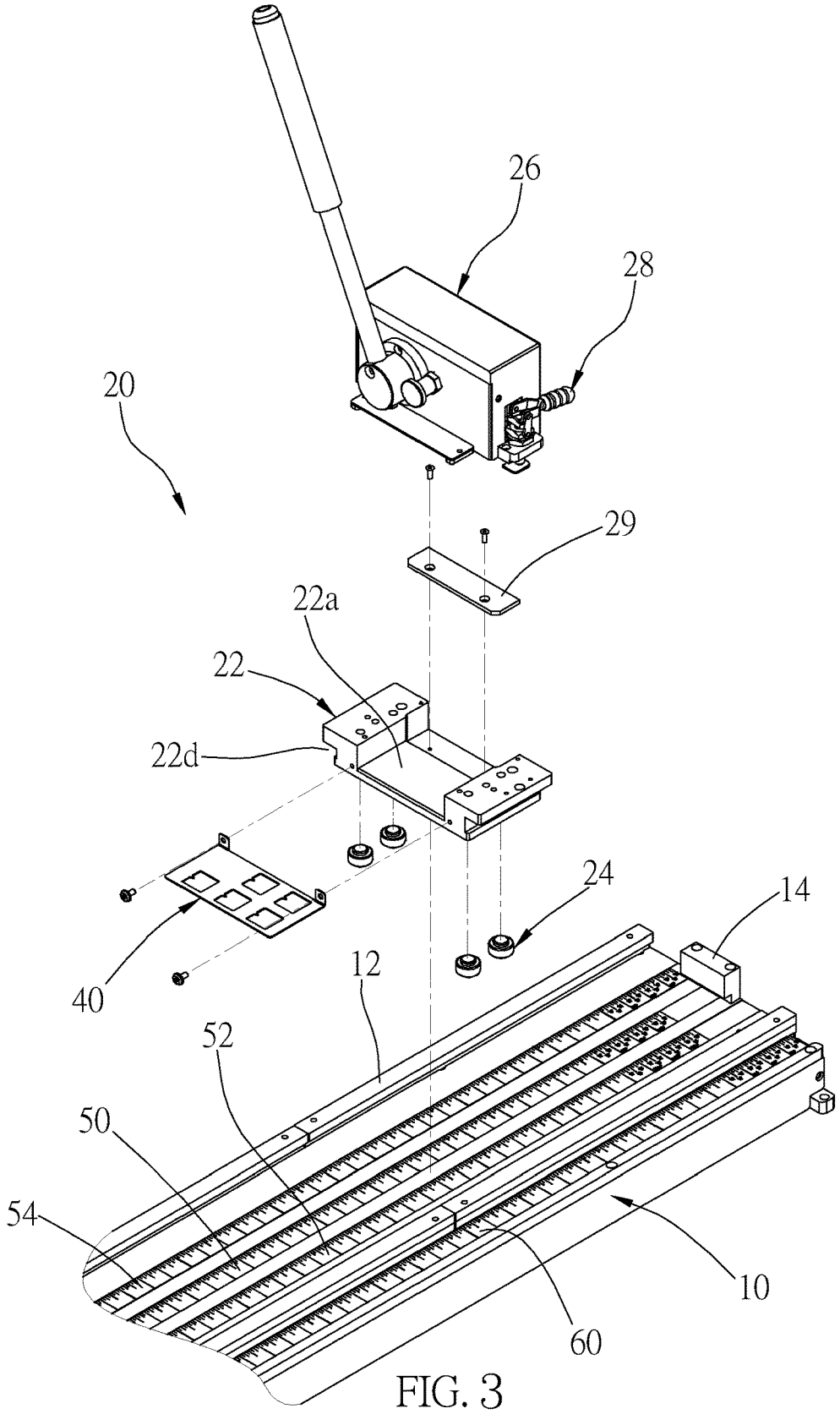
FIG. 3 is an exploded view of the first cutting device of the cutting machine illustrated in FIG. 2.
Figure 4:
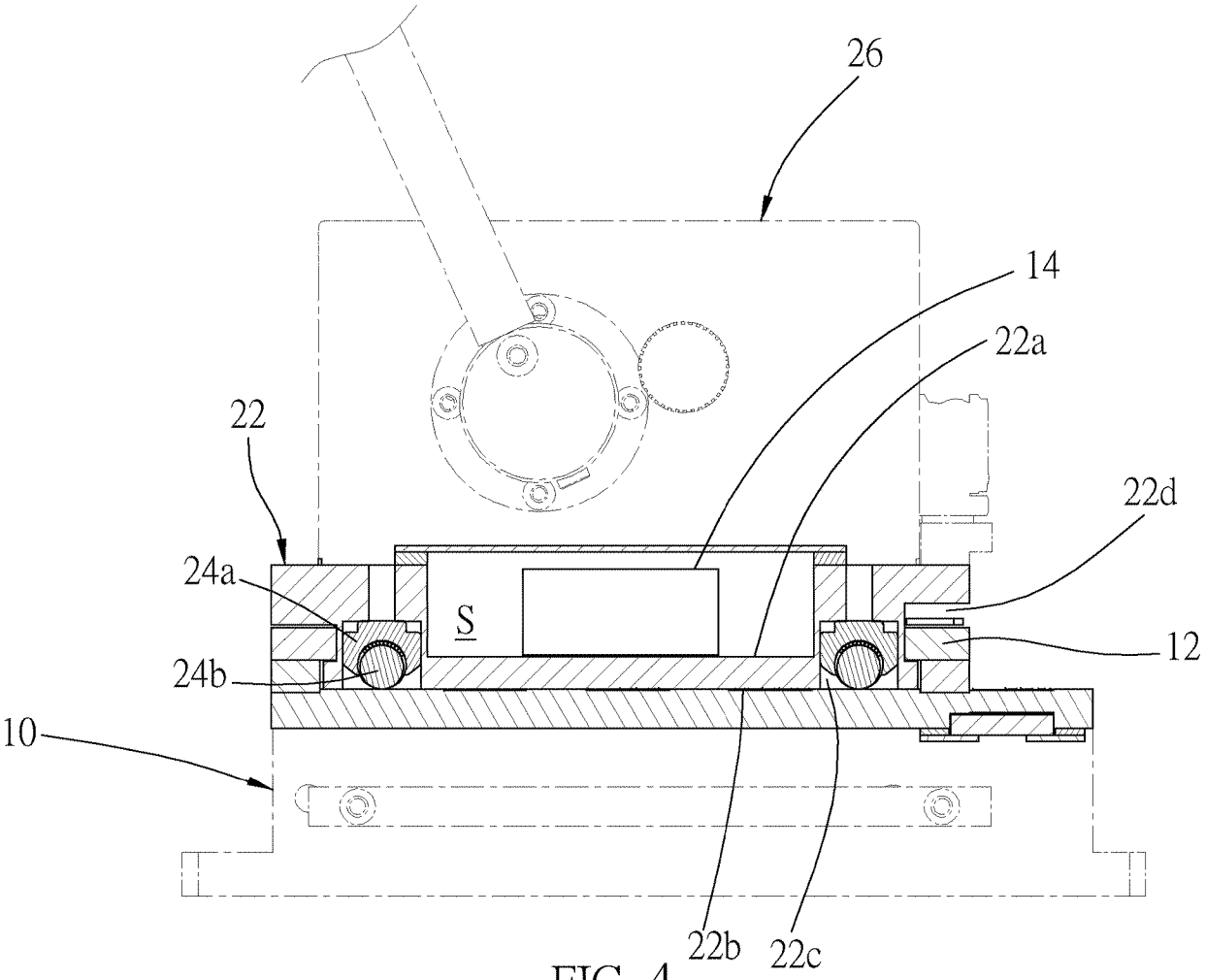
FIG. 4 is a partial sectional view, showing the relation between the sliding seat and the rolling member.
Figure 5:
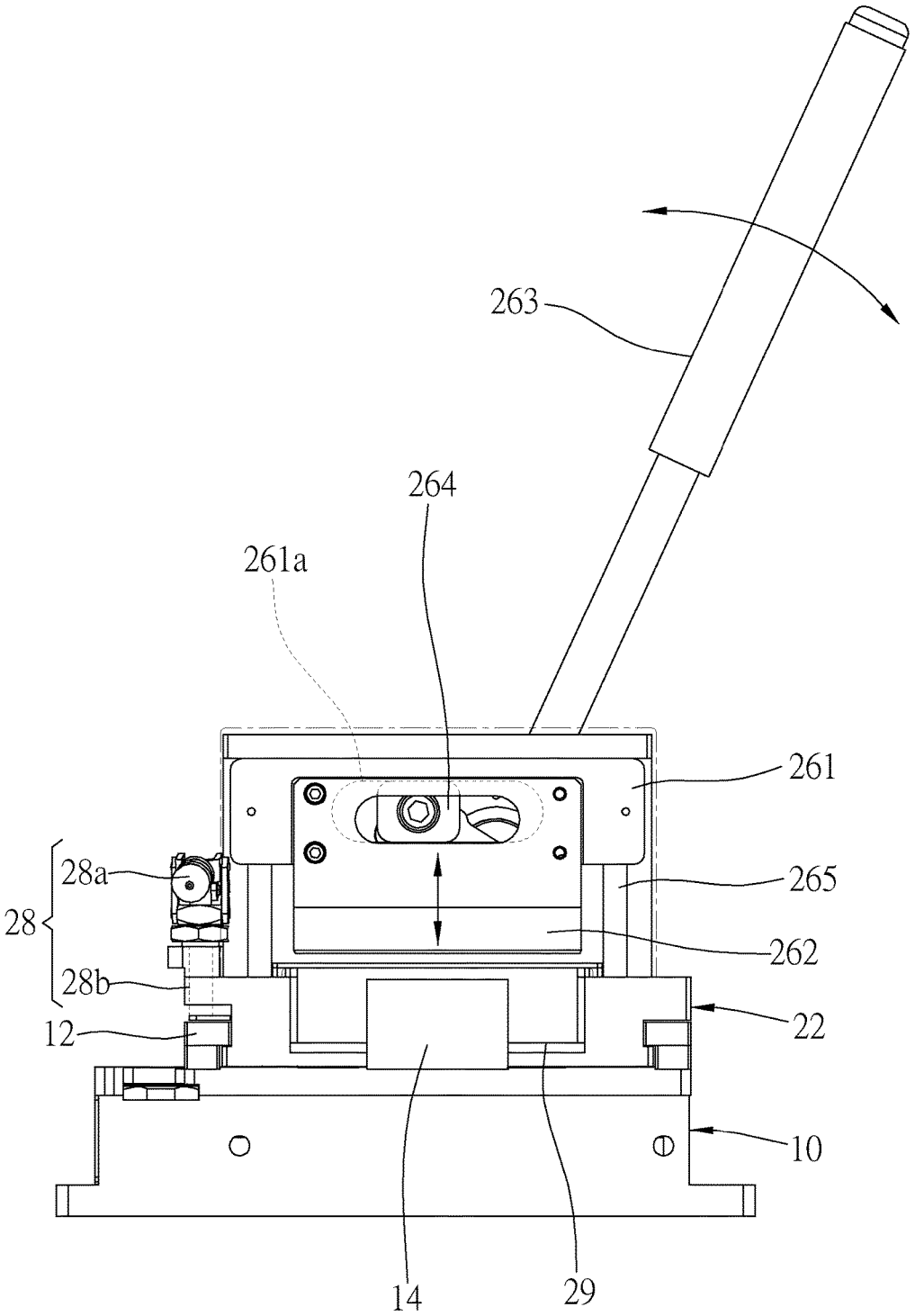
FIG. 5 is a right side view of FIG. 2.

As shown in FIG. 3 to FIG. 5, the first cutting device 20 is movably provided on the worktable 10 in a slidable way, and is movable toward and away from the second cutting device 30. The first cutting device 20 includes a sliding seat 22, a plurality of rolling members 24, a cutter 26, and a securing device 28, wherein the sliding seat 22 has a top surface 22*a* and a bottom surface 22*b* which is opposite to the top surface 22*a*, and has a plurality of insertion grooves 22*c* formed on the bottom surface 22*b*. The sliding seat 22 has two slots 22*d* provided at two opposite sides thereof respectively, wherein each of the slots 22*d* corresponds to one of the rails 12, so that the sliding seat 22 is able to slide along the rails 12. In addition, a lining sheet 29, which is an aluminum sheet as an example, is securely provided on the sliding seat 22, wherein a surface of the lining sheet 29 aligns with the top surface 22*a*.

The rolling members 24 respectively include a socket 24*a* and a ball 24*b*, wherein each of the sockets 24*a* is seated in a corresponding insertion groove 22*c*, while each of the balls 24*b* is rotatably installed in one of the sockets 24*a*. In the current preferred embodiment, each of the rolling members 24 is a ball transfer unit, wherein only a small part of a surface of each of the balls 24*b* is exposed out of the bottom surface 22*b* of the sliding seat 22 to contact with a table surface of the worktable 10. In this way, the sliding seat 22 is movable along a long axis of the table surface, and a distance between the top surface 22*a* of the sliding seat 22 and the table surface of the worktable 10 is short.

The cutter 26 is engaged to the sliding seat 22, and is above the sliding seat 22. An opening S is formed between a bottom surface of the cutter 26 and the top surface 22*a* of the sliding seat 22. As shown in FIG. 5, the cutter 26 includes a moving member 261, a cutting knife 262, a joystick 263, and a sliding block 264, wherein the moving member 261 is movable up and down relative to the sliding seat 22 along two posts 265, and the moving member 261 has a transverse slot 261*a*. The cutting knife 262 is securely fixed to the moving member 261, wherein a knife edge thereof faces down and corresponds to the lining sheet 29. The joystick 263 can be pulled to laterally move the sliding block 264 received in the transverse slot 261*a*, and then to consequently move the moving member 261 and the cutting knife 262 up and down together.

The securing device 28 is connected to the sliding seat 22, and includes a handle 28*a* and a rod 28*b*, wherein the handle 28*a* can be pulled up and down; the rod 28*b* goes through the sliding seat 22, and can be moved by the handle 28*a* to tightly abut against a surface of one of the rail 12 with a bottom end thereof, so that the first cutting device 20 which includes the sliding seat 22 can be firmly fixed at a predetermined position on the worktable 10. On the contrary, by pulling the handle 28*a* in an opposite direction, the first cutting device 20 is released, and therefore can be moved to another predetermined position to be fixed there.

Figure 6:
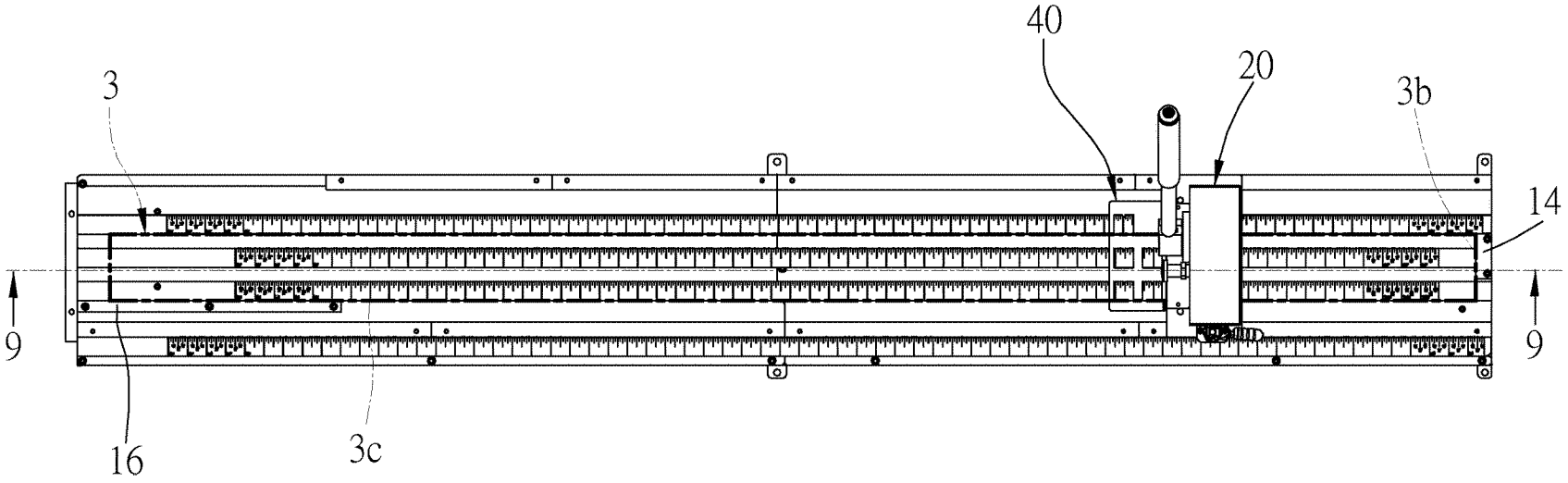
FIG. 6 is a top view, showing the relation between the first cutting device and the worktable.
Figure 7:
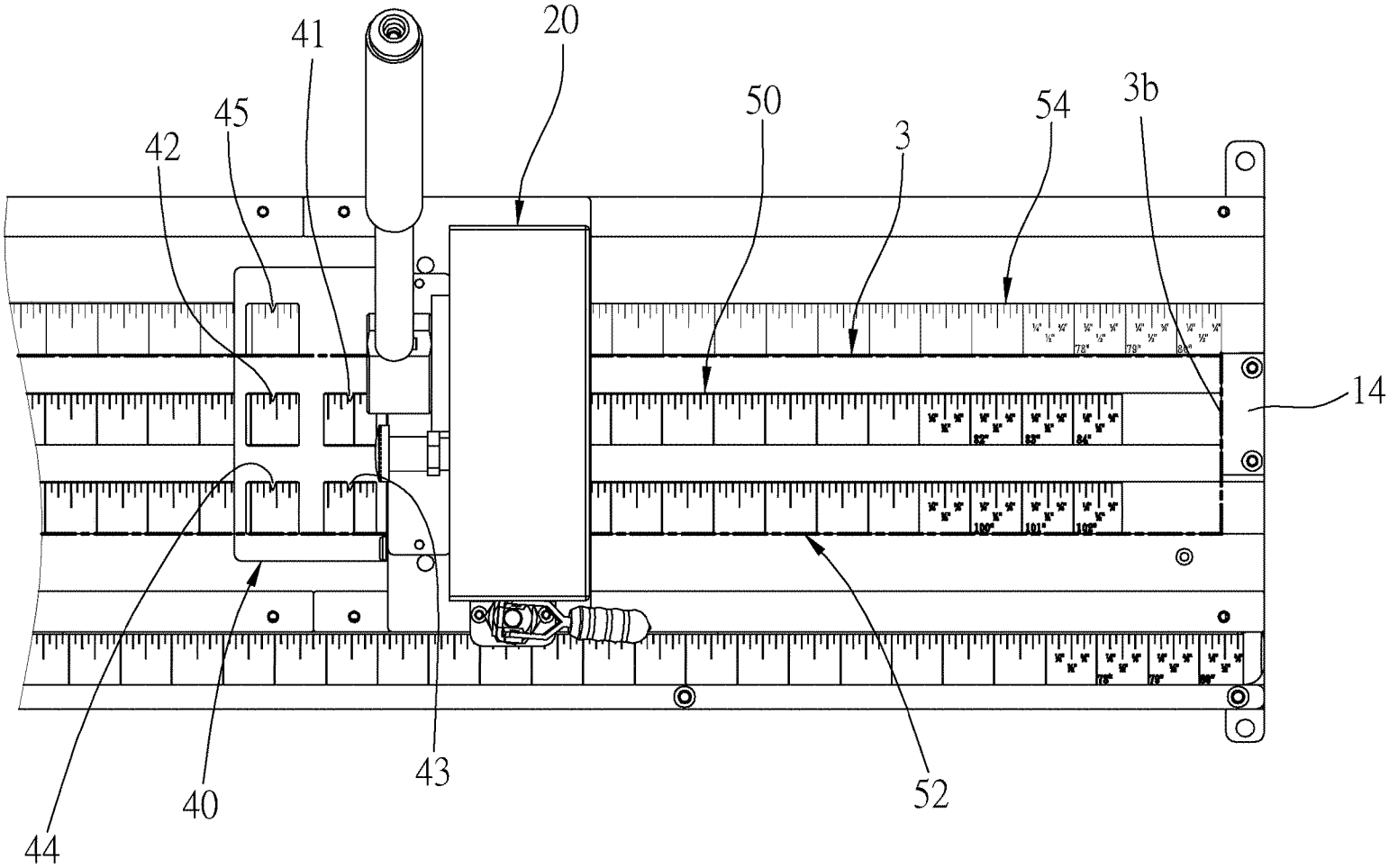
FIG. 7 is a partial enlarged view of FIG. 6.
Figure 8:
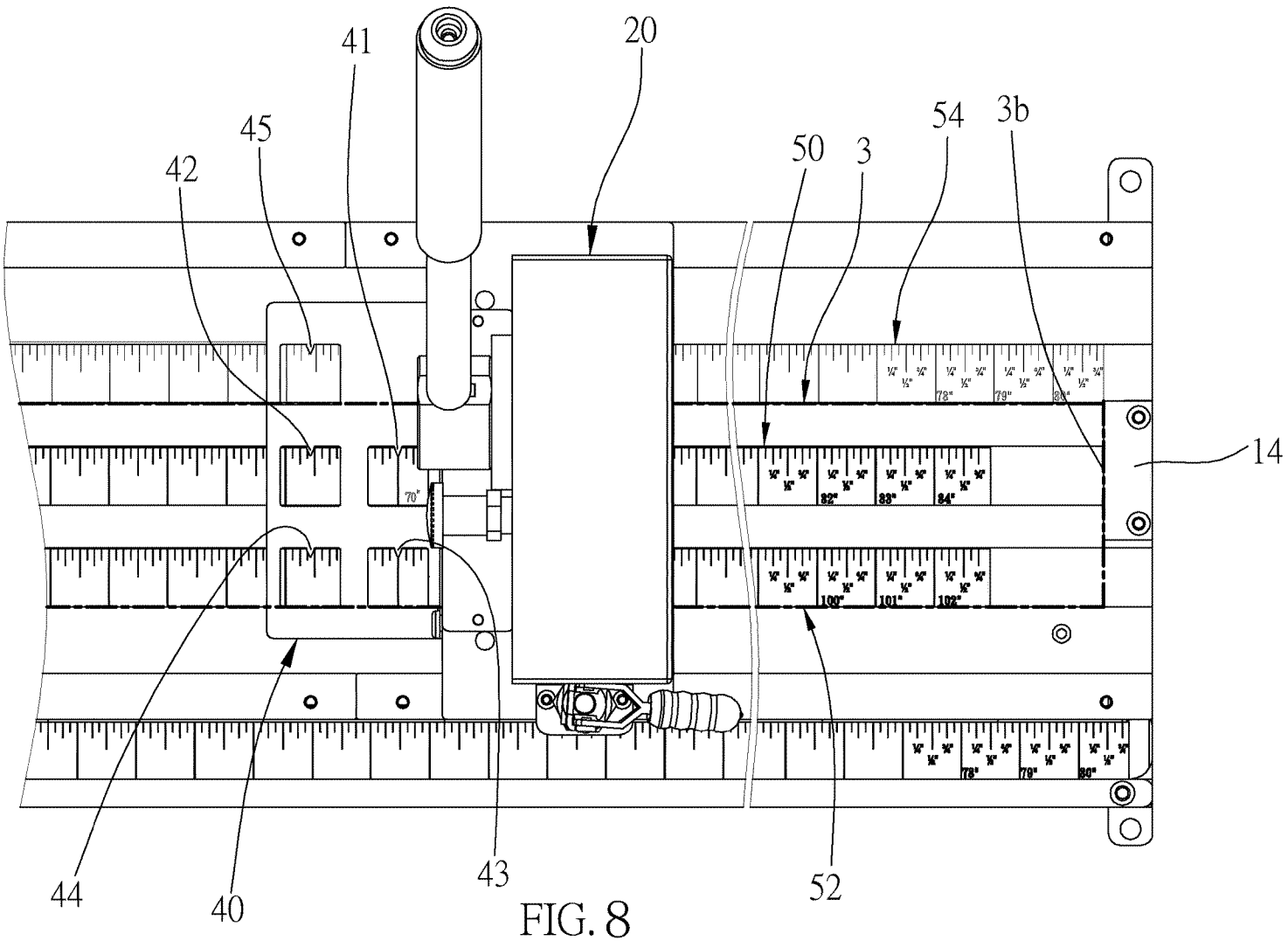
FIG. 8 is a partial enlarged view FIG. 7.
Figure 9:
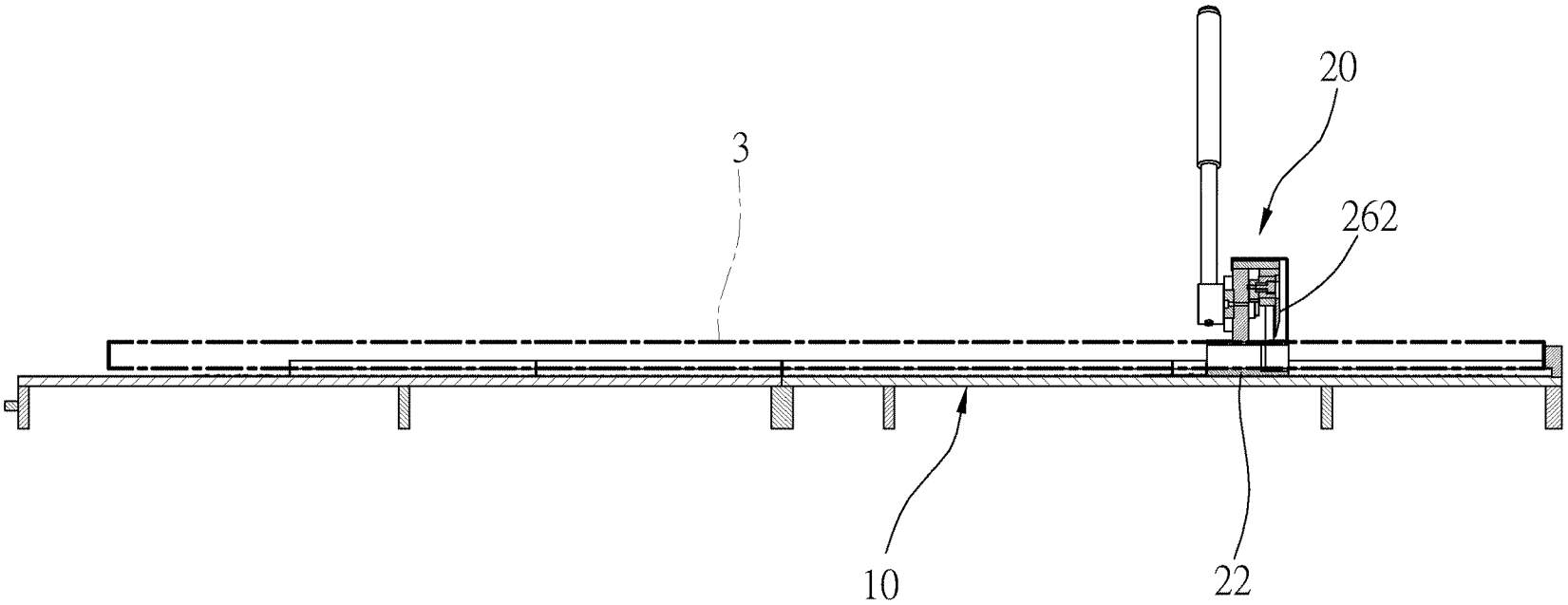
FIG. 9 is a sectional view along the 9-9 line in FIG. 6.

As shown in FIG. 6 to FIG. 8, to cut the plurality of slats 3, the slats 3 has to be stacked to pass through the opening S formed between the sliding seat 22 and the cutter 26 with an end thereof first, and then make the end edge 3*b* of the stacked slats 3 abut against the first abutting member 14, and make the lateral edge 3*c* of the stacked slats 3 abut against the second abutting member 16, so that the stacked slats 3 are adequately supported and fixed, which not only ensures that the stacked slats 3 go straight into the opening S, but also helps to stabilize the stacked slats 3 while being cut. In this way, the problem of irregular cut surface, which may happen due to some slats 3 may shift or bias during the cutting process, can be avoided. As illustrated in FIG. 9, after the stacked slats 3 pass through the opening S, the stacked slats 3 are ready to be cut by the cutting knife 262 in a substantially horizontal way, for the distance between the top surface 22*a* of the sliding seat 22 which bears the slats 3 and the table surface of the worktable 10 is short. As a result, the resultant cut surface would be regular and smooth, and the slats 3 would have a consistent length after being cut.

In addition, the cutting machine 100 of the preferred embodiment in the present invention is further able to precisely and quickly define a cut size for slats of two different standard products which have different lengths, so that the resultant slats can further meet actual requirements for installation. Herein we take the standard products of slats of 84 inches and 102 inches for example.

As shown in FIG. 7, the cutting machine 100 includes a caliper 40, which is preferred to be connected to the first cutting device 20 to be moved along with the first cutting device 20 in the current preferred embodiment. The table surface of the worktable 10 has a series of first extending graduation marks 50 and a series of second extending graduation marks 52 provided in parallel thereon along the long axis thereof. The scale values of the series of first extending graduation marks 50 and the series of second extending graduation marks 52 both decrease from the side near the first abutting member 14 to the side away from the first abutting member 14. As shown in FIG. 8, the scale value of the series of first extending graduation marks 50 reads 84" at a start end thereof near the first abutting member 14, which means the first extending graduation marks 50 are adapted to measure a length of slats of standard products of 84 inches before cutting; the scale value of the series of second extending graduation marks 52 at a start end thereof near the first abutting member 14 is greater than that of the first extending graduation marks 50, and reads 102", which means the second extending graduation marks 52 are adapted to measure a length of slats of standard products of 102 inches before cutting. Furthermore, the start ends of the series of first extending graduation marks 50 and the second extending graduation marks 52 align with each other at where is about 4 inches away from the first abutting member 14. This 4-inch distance makes the resultant slats 3 have an additional length to match the beam 2, and therefore the resultant slats 3 can be efficiently installed to the window opening.

The caliper 40 is a thin plate resting on the table surface, wherein the caliper 40 has two openings corresponding to the series of first extending graduation marks 50. One of the openings has a first internal gauge point 41, which is a cusp, and the other opening has a first external gauge point 42, which is also a cusp, wherein the first internal gauge point 41 is closer to the first cutting device 20 (and the cutting knife 262) than the first external gauge point 42. In other words, when the first cutting device 20 is fixed at a predetermined position on the worktable 10, the scale value of the first extending graduation marks 50 pointed by the first internal gauge point 41 is greater than the scale value of the first extending graduation marks 50 pointed by the first external gauge point 42.

With the aforementioned design, if a user requires to install slats of standard products of 84 inches (say the slats 3) with inside mount, the end edge 3*b* of the stacked slats 3 which has no hanging holes 3*a* has to abut against the first abutting member 14 (i.e., another end edge of the stacked slats 3 which has the hanging holes 3*a* is closer to the second cutting device 30), and then, by moving the first cutting device 20 till the scale value pointed by the first internal gauge point 41 of the caliper 40 matches the size of the window opening, the resultant slats 3 would perfectly cover the window opening after being cut, engaged with the beam 2, and installed into the window opening. For example, if the window opening is measured 70 inches in height, the slats 3 suitable to be installed in the window opening can be obtained by moving the first cutting device 20 till the scale value of the first extending graduation marks 50 pointed by the first internal gauge point 41 of the caliper 40 reads "70", as illustrated in FIG. 8.

On the other hand, if the slats are required to be installed with outside mount, it is the first external gauge point 42 to point at the scale value corresponding to the height of the window opening. In this way, the resultant slates after being cut would be slightly longer than the height of the window opening, so that the slats 3 can effectively cover the window covering once installed. It has to explain that, in addition to the height of the window covering, a user can alternatively use a determined length as a basis for cutting if he/she wants the slats to cover a larger area, though the resultant slats 3 may be much longer than the actual height of the window opening. With the aforementioned method of measuring, no matter it's for inside mount or outside mount, a user only needs to memorize the height of the window covering without needing any complicated methods to estimate the cut length, and the length of the resultant slats would be just appropriate, neither too long nor too short. Therefore, the cutting machine 100 provided in the present invention has the effect of precisely and quickly defining a cut size for cutting slats.

The caliper 40 further has two more openings corresponding to the series of second extending graduation marks 52, wherein one of these two openings has a second internal gauge point 43, which is a cusp, while the other opening has a second external gauge point 44, which is also a cusp. Similarly, the second internal gauge point 43 is closer to the first cutting device 20 than the second external gauge point 44. To cut slats of standard products of 102 inches for inside mount, the first cutting device 20 has to be moved till the scale value pointed by the second internal gauge point 43 matches the height of the window opening. Alternatively, for outside mount, the first cutting device 20 has to be moved till the scale value pointed by the second external gauge point 44 matches the height of the window opening. After that, by simply cutting the slats 3 at position, the resultant slats 3 would have a required length suitable for installation.

To use the cutting machine 100, the first cutting device 20 has to be moved first to make one internal gauge point or one external gauge point stop at the scale value corresponding to the height of the window opening, and then the first cutting device 20 has to be firmly fixed on the worktable 10. After that, the slats 3 can be placed on the table surface of the worktable 10 to be cut. In this way, the pointed scale value of the first extending graduation marks 50 (or the second extending graduation marks 52) can be clearly read without being hindered by the slats 3. Of course, if the series of first extending graduation marks 50 (or the series of second extending graduation marks 52) are provided at other positions on the table surface of the worktable 10 where would not be hindered, the slats 3 can be placed on the table surface first before moving the first cutting device 20. In addition, at where corresponding to each of the internal gauge points or each of the external gauge points, a surface of the caliper 40 can be provided with wordings or labels for clearer identification, whereby a user would be able to adjust the first cutting device 20 to a predetermined position even faster and easier.

In the aforementioned embodiment, the caliper 40 is connected to the first cutting device 20, and is moved along with the first cutting device 20. However, in practice, the caliper 40 can be also separated from the first cutting device 20, and is independently movable. In such cases, the caliper 40 has to be moved to a predetermined position first, and then the first cutting device 20 is moved in position.

It is worth mentioning that, the cutting machine 100 of the preferred embodiment further provides the function of re-cutting. In other words, flawed slats can be cut again to become usable products. Flawed slats mentioned herein are slats of standard products which are accidentally over cut and therefore have a length shorter than expected. For example, given the expected length is 60 inches, but the resultant slats are only 58 inches, these slats are what we say flawed, and such slats cannot be installed.

To process the flawed slats, the cutting machine 100 is further provided with a series of third extending graduation marks 54 on the table surface of the worktable 10, wherein the series of third extending graduation marks 54 is also provided along a long axis of the table surface, and the scale value decreases from an end near the first abutting member 14 to another end away from the first abutting member 14. In the preferred embodiment, the scale value at a start end (i.e., the maximum scale value) of the series of third extending graduation marks 54 near the first abutting member 14 is less than the scale value at the start end (i.e., the maximum scale value) of the series of first extending graduation marks 50, and reads 79". The caliper 40 further has an opening corresponding to the series of third extending graduation marks 54, wherein the opening has a third gauge point 45, which is a cusp. The third gauge point 45 is used to point at the scale value of the series of third extending graduation marks 54. In addition, a third abutting member (not shown) is further provided on the worktable 10, wherein the third abutting member is located at another end of the worktable 10 corresponding to the first abutting member 14. To re-cut the flawed slats, the first cutting device 20 is moved first to make the third gauge point 45 point at the scale value of the series of third extending graduation marks 54 corresponding to an expected value, which may be the height of another window opening owned by the owner of the flawed slats, or may be the height of another window opening in someone else's house. After that, the flawed slats, say the slats 3 again, go into the opening S with the end edge having the hanging holes 3*a* abutting against the third abutting member to be cut. In this way, such flawed slats are not necessary to be discarded, but can be further cut to become usable again, which apparently helps to avoid unnecessary waste.

Figure 10:
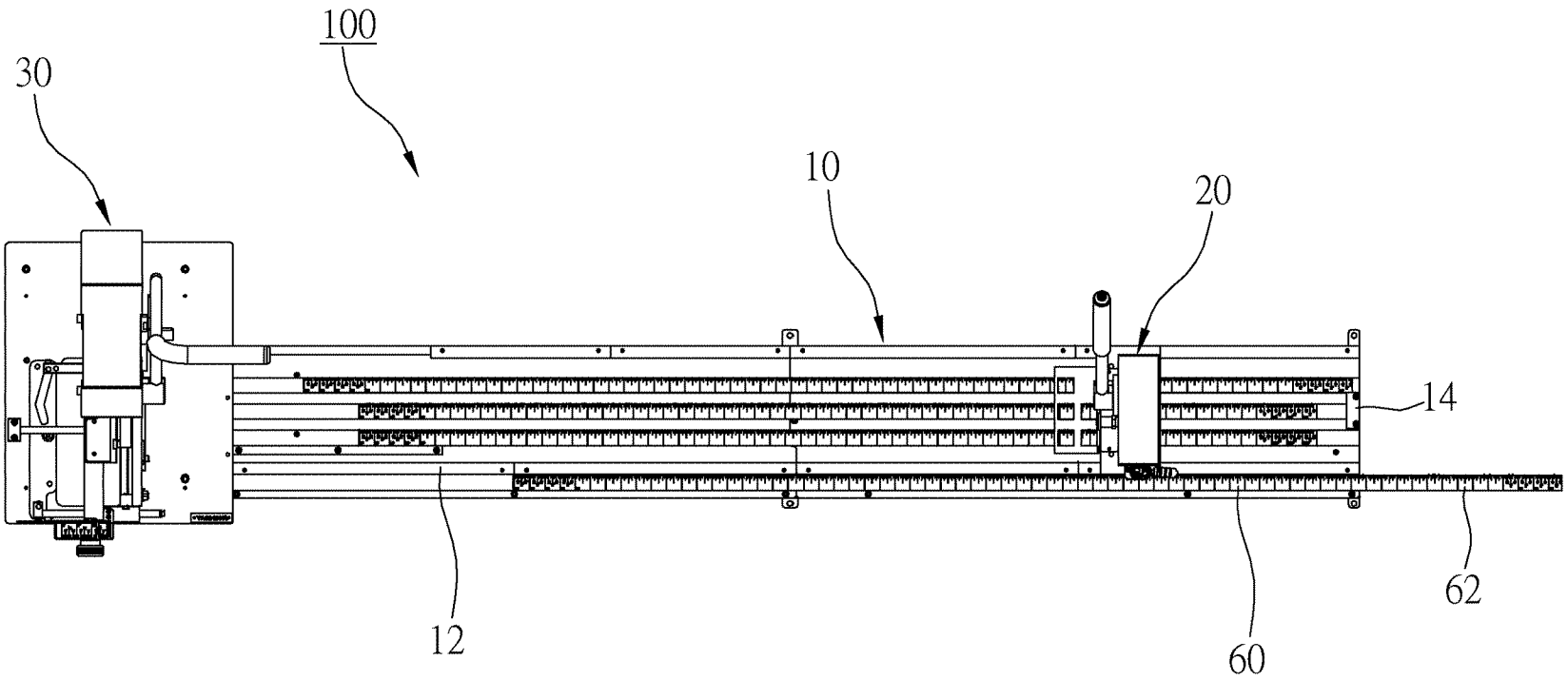
FIG. 10 is a top view of the aforementioned preferred embodiment, showing a ruler is pulled out relative to the worktable.

The description above mainly focuses on cutting slats; however, the cutting machine 100 of the present invention further provides the function of cutting beams (e.g., the beam 2), and the details are describe below. As shown in FIG. 10, a series of fixed extending marks 60 is provided on the table surface of the worktable 10 along the long axis thereof, wherein the scale value of the series of fixed extending marks 60 also decreases from an end thereof near the first abutting member 14 to an end thereof away from the first abutting member 14. Take the second cutting device 30 as a reference basis, the scale value of the series of fixed extending marks 60 increases in a direction away from the second cutting device 30. In addition, a ruler is further provided under the table surface of the worktable 10, wherein the ruler can be pulled out, and has a series of auxiliary extending marks 62 provided on a surface thereof. The scale value of the series of auxiliary extending marks 62 starts from an end scale value of the series of fixed extending marks 60, e.g., 82", and increases in a direction away from the second cutting device 30. While at use, an end edge of a beam abuts against an abutting portion (not shown) on the second cutting device 30, and a lateral edge of the beam abuts against one of the rails 12. After that, the scale values of the series of fixed extending marks 60 or the series of auxiliary extending marks 62 are used to define a cut length. In the end, the second cutting device 30 is operated to cut the beam.

In summary, the cutting machine 100 of the preferred embodiment can not only precisely and quickly define a cut size according to the requirements for installation, but also provide the function of cutting flawed slats to make them become usable again. Furthermore, the cutting machine 100 can be used to cut beams of a window covering. Therefore, the cutting machine 100 is a highly practical invention.

It must be pointed out that the embodiments described above are only some preferred embodiments of the present invention. All equivalent structures which employ the concepts disclosed in this specification and the appended claims should fall within the scope of the present invention.

What is claimed is:

1. A cutting machine for window coverings, comprising:

a worktable, which has a first abutting member and a series of first extending graduation marks provided on a table surface thereof, wherein the first abutting member projects from the table surface; the series of first extending graduation marks are provided along a longitudinal axis of the table surface, and a scale value thereof decreases from an end thereof near the first abutting member to another end away from the first abutting member;

a first cutting device, which is movably provided on the worktable, and is slidable along the longitudinal axis of the table surface, wherein the first cutting device is adapted to cut slats of a window covering;

a caliper, which is adapted to mark a length of the slats for locating the cutting device on the worktable, wherein the caliper comprises a first internal gauge point and a first external gauge point; when the caliper is fixed on a predetermined position on the worktable, the scale value of the series of first extending graduation marks pointed by the internal gauge point is greater than the scale value of the series of first extending graduation marks pointed by the external gauge point.

2. The cutting machine of claim 1, wherein a series of second extending graduation marks are provided on the table surface of the worktable; the series of second extending graduation marks are provided along the longitudinal axis of the table surface, and a scale value thereof decreases from an end thereof near the first abutting member to another end thereof away from the first abutting member; the maximum scale value of the series of second extending graduation marks which is read at the end thereof near the first abutting member is greater than the maximum scale value of the series of first extending graduation marks which is read at the end thereof near the first abutting member; the caliper comprises a second internal gauge point and a second external gauge point; when the first cutting device is fixed at a predetermined position on the worktable, the scale value of the series of second extending graduation marks pointed by the second internal gauge point is greater than the scale value of the series of second extending graduation marks pointed by the second external gauge point.

3. The cutting machine of claim 1, wherein a series of third extending graduation marks are provided on the table surface of the worktable; the series of third extending graduation marks are provided along the longitudinal axis of the table surface, and a scale value thereof decreases from an end thereof near the first abutting member to another end thereof away from the first abutting member; the maximum scale value of the series of third extending graduation marks which is read at the end thereof near the first abutting member is less than the maximum scale value of the series of first extending graduation marks which is read at the end thereof near the first abutting member; the caliper comprises a third gauge point, which is adapted to point at the scale value of the series of third extending graduation marks.

4. The cutting machine of claim 1, wherein the worktable comprises a series of auxiliary extending marks, which are provided on a ruler; the ruler is connected to the worktable, and is adapted to be pulled out relative to the worktable.

5. The cutting machine of claim 4, further comprising a second cutting device provided on the worktable, wherein the second cutting device and the series of auxiliary extending marks are at opposite sides of the worktable; the second cutting device is adapted to cut beams of the window covering; a series of fixed extending marks are provided on the table surface of the worktable, wherein the series of fixed extending marks are provided along the longitudinal axis of the table surface, and a scale value thereof decreases from an end thereof near the first abutting member to another end thereof away from the first abutting member; a scale value of the series of auxiliary extending marks starts from an end scale value of the series of fixed extending marks, and increases.

6. The cutting machine of claim 1, wherein the first cutting device comprises a sliding seat, a plurality of rolling members, and a cutter, wherein the sliding seat has a top surface and a bottom surface opposite to the top surface; each of the rolling members is provided in the sliding seat, wherein a part of a surface of each of the rolling members is exposed out of the bottom surface of the sliding seat; the part of each of the rolling members exposed out of the bottom surface contacts the table surface of the worktable; the cutter is engaged on the sliding seat, wherein an opening is formed between the cutter and the top surface of the sliding seat; a cutting knife of the cutter is adapted to cut the slats of the window covering which pass through the opening.

7. The cutting machine of claim 6, wherein the cutting device comprises a securing device, which is adapted to fix the sliding seat at a predetermined position on the worktable.

8. The cutting machine of claim 6, wherein the sliding seat has a plurality of insertion grooves formed on the bottom surface thereof; each of the rolling members comprises a ball, wherein each of the balls is rotatably seated in one of the insertion grooves with a part of a surface thereof exposed out of the bottom surface of the sliding seat.

9. The cutting machine of claim 6, wherein the cutter comprises a joystick, a sliding block, and a moving member; the joystick is adapted to be pulled to laterally move the sliding block along a transverse slot of the moving member, which also moves the moving member up and down relative to the worktable; the moving member is connected to the cutting knife.

10. The cutting machine of claim 1, wherein a second abutting member is further provided on the table surface of the worktable at an end thereof away from the first abutting member; the second abutting member is adapted to be abutted against by a lateral edge of the slats.

11. The cutting machine of claim 1, wherein the caliper is connected to the cutting device, and is movable along with the cutting device.

* * * * *